US009471025B2

(12) United States Patent
Iikura

(10) Patent No.: US 9,471,025 B2
(45) Date of Patent: Oct. 18, 2016

(54) CONTACT MEMBER, IMAGE CARRIER, AND IMAGE FORMING APPARATUS

(71) Applicant: FUJI XEROX CO., LTD., Tokyo (JP)

(72) Inventor: Kazuaki Iikura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/537,442

(22) Filed: Nov. 10, 2014

(65) Prior Publication Data

US 2015/0370212 A1 Dec. 24, 2015

(30) Foreign Application Priority Data

Jun. 23, 2014 (JP) ..... 2014-128497

(51) Int. Cl.
*G03G 15/00* (2006.01)

(52) U.S. Cl.
CPC ..... *G03G 15/751* (2013.01); *G03G 15/75* (2013.01); *G03G 15/757* (2013.01); *G03G 2221/1606* (2013.01)

(58) Field of Classification Search
None
See application file for complete search history.

(56) References Cited

U.S. PATENT DOCUMENTS 4,134,669 A * 1/1979 Reitner ..... G03G 15/751 399/130
5,739,900 A * 4/1998 Isobe ..... G03G 15/0935 29/895.22
5,802,443 A * 9/1998 Matsumoto ..... F16C 13/00 29/515
6,205,308 B1 3/2001 Tanaka et al.
6,406,656 B1 * 6/2002 Thompson ..... G03G 15/751 264/328.1
8,121,521 B2 * 2/2012 Bateman, III ..... G03G 15/75 399/116
8,768,217 B2 * 7/2014 Yagata ..... G03G 15/757 399/167
8,958,731 B2 * 2/2015 Ouchi ..... G03G 15/0189 399/167
2004/0042822 A1 * 3/2004 Fujishiro ..... G03G 15/751 399/159
2007/0237545 A1 * 10/2007 Cho ..... G03G 15/751 399/117
2010/0221041 A1 * 9/2010 Takai ..... G03G 15/751 399/159
2011/0116836 A1 * 5/2011 Huang ..... G03G 15/757 399/167
2013/0221560 A1 * 8/2013 Kawai ..... G03G 5/147 264/104
2015/0078783 A1 * 3/2015 Iikura ..... G03G 15/751 399/159
2015/0370213 A1 * 12/2015 Iikura ..... G03G 15/751 399/117
2016/0026143 A1 * 1/2016 Ichikawa ..... G03G 15/75 399/159

FOREIGN PATENT DOCUMENTS

JP A-8-54804 2/1996
JP 2000321929 A 11/2000
JP A-2004-11854 1/2004
JP 2004251401 A 9/2004
JP 2005010428 A 1/2005
JP A-2007-25019 2/2007

OTHER PUBLICATIONS

Dec. 16, 2014 Office Action issued in Japanese Patent Application No. 2014-128497.

* cited by examiner

*Primary Examiner* — David Gray
*Assistant Examiner* — Geoffrey T Evans
(74) *Attorney, Agent, or Firm* — Oliff PLC

(57) ABSTRACT

A contact member is substantially arc-shaped along an inner peripheral surface of a cylindrical body while being supported in contact with an inside of the cylindrical body, when viewed from an axial direction of the cylindrical body. The contact member has at least one projection projecting from an inner peripheral surface of the contact member.

8 Claims, 8 Drawing Sheets

CONTACT MEMBER, IMAGE CARRIER, AND IMAGE FORMING APPARATUS

CROSS-REFERENCE TO RELATED APPLICATIONS

This application is based on and claims priority under 35 USC 119 from Japanese Patent Application No. 2014-128497 filed Jun. 23, 2014.

BACKGROUND (i) Technical Field

The present invention relates to a contact member, an image carrier, and an image forming apparatus.

(ii) Related Art

In the related art, a cylindrical body (photoconductor drum) is made of metal, and a contact member disposed within the cylindrical body is made of resin. When disposing of an imaging forming apparatus, it is necessary to separate the cylindrical body and the contact member for recycling. For that purpose, the operator inserts a distal end of a columnar rodlike member from one side of the cylindrical body, and pushes the contact member supported within the cylindrical body with the distal end of the rodlike member. The contact member is thereby taken out from the other side of the cylindrical body.

In this operation, the force for pushing the contact member out of the inside of the cylindrical member is sometimes not sufficiently transmitted to the contact member because an outer peripheral surface of the rodlike member and an inner surface of the cylindrical member rub together.

SUMMARY

According to an aspect of the invention, there is provided a contact member provided in a substantially arc shape along an inner peripheral surface of a cylindrical body while being supported in contact with an inside of the cylindrical body, when viewed from an axial direction of the cylindrical body, and having at least one projection projecting from an inner peripheral surface of the contact member.

BRIEF DESCRIPTION OF THE DRAWINGS

Exemplary embodiments of the present invention will be described in detail based on the following figures, wherein.

DETAILED DESCRIPTION

First Exemplary Embodiment

A contact member, an image carrier, and an image forming apparatus according to a first exemplary embodiment of the present invention will be described with reference to FIGS. 1A, 1B, and 1C to FIGS. 6A, 6B, and 6C. In the figures, arrow H shows an apparatus up-down direction (vertical direction), arrow W shows an apparatus width direction (horizontal direction), and arrow D shows an apparatus depth direction (horizontal direction).

Overall Configuration

Figure 5:
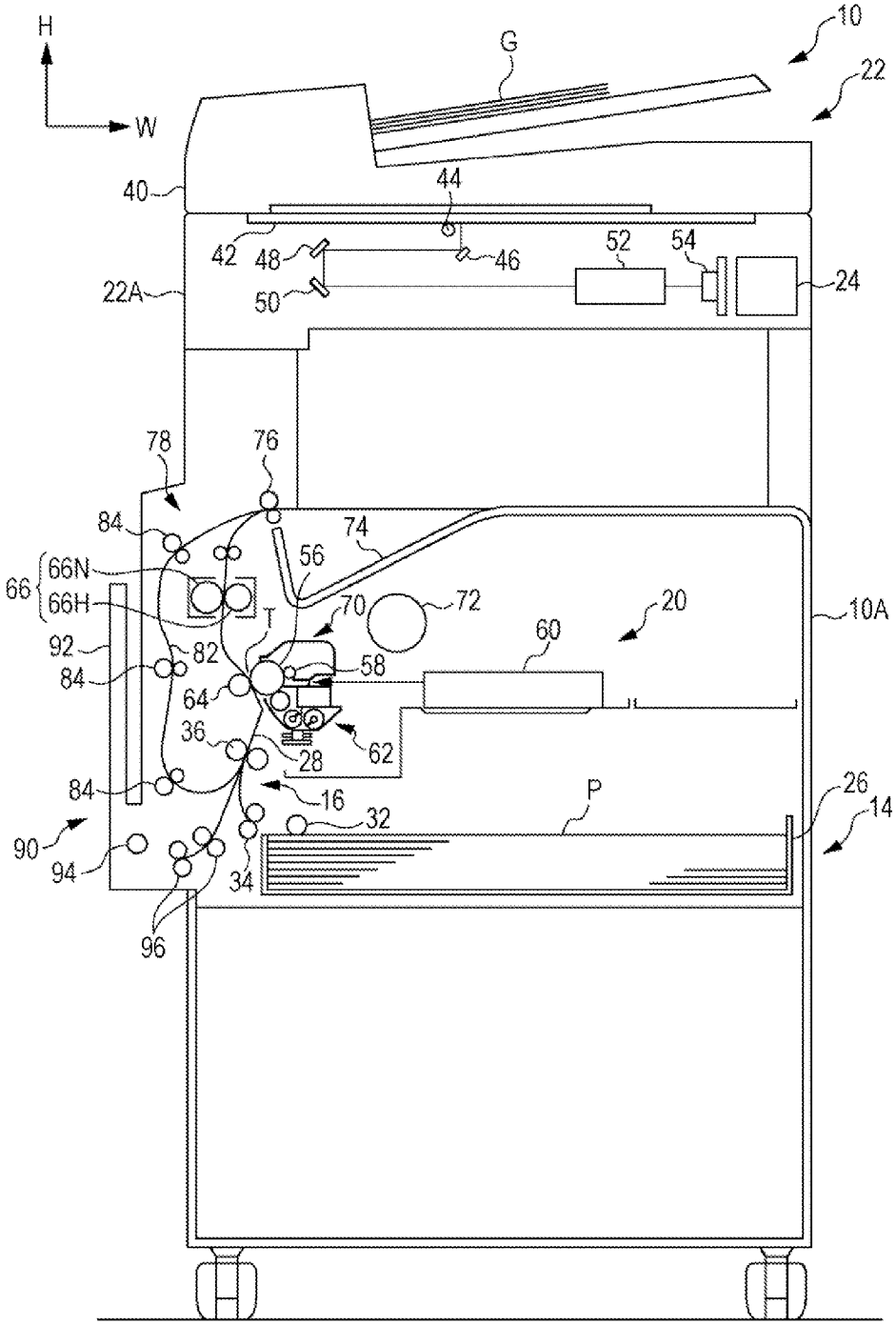
FIG. 5 is a schematic configuration view of the image forming apparatus of the first exemplary embodiment.

As illustrated in FIG. 5, in an image forming apparatus 10 according to the first exemplary embodiment, a storage section 14, a transport section 16, an image forming section 20, and a document reading section 22 are provided in this order from a lower side toward an upper side in the apparatus up-down direction (direction of arrow H). The storage section 14 stores sheet members P serving as recording media. The transport section 16 transports the sheet members P stored in the storage section 14. The image forming section 20 forms images on the sheet members P transported from the storage section 14 by the transport section 16. The document reading section 22 reads a read document G. The image forming apparatus 10 further includes a manual paper feed section 90 from which a sheet member P is supplied manually.

Storage Section

The storage section 14 includes a storage member 26 that can be drawn out from an apparatus body 10A of the image forming apparatus 10 toward a front side in the apparatus depth direction. In the storage member 26, sheet members P are stacked. The storage section 14 further includes a feed roller 32 that feeds out the stacked sheet members P to a transport path 28 that configurates the transport section 16.

Transport Section

The transport section 16 includes separation rollers 34 disposed on a downstream side of the feed roller 32 in a transport direction of sheet members P (hereinafter simply referred to as a "transport-direction downstream side") to separate and transport the sheet members P one by one.

On the transport-direction downstream side of the separation rollers 34 in the transport path 28, registration rollers 36 are disposed to temporarily stop a sheet member P and to feed out the sheet member P to a transfer position T (to be described later) at a predetermined timing.

At a terminal end of the transport path 28, output rollers 76 are disposed to output a sheet member P, on which an image is formed by the image forming section 20, into an output portion 74 provided above the image forming section 20.

To form images on both sides of a sheet member P, a double-side transport unit 78 for inverting the sheet member P is provided in a side part of the apparatus body 10A. The double-side transport unit 78 includes a reverse path 82 into which a sheet member P is transported by reversing the output rollers 76. Further, plural transport rollers 84 are disposed along the reverse path 82. The sheet member P sent by the transport rollers 84 is transported to the registration rollers 36 again, in an inverted state.

Manual Paper Feed Section

Next to the double-side transport unit 78, the fording manual paper feed section 90 is provided. The manual paper feed section 90 includes an openable manual paper feed member 92. The manual paper feed section 90 further includes a paper feed roller 94 and plural transport rollers 96 that transport a sheet member P fed from the open manual paper feed member 92. The sheet member P transported by the transport rollers 96 is transported to the registration rollers 36.

Document Reading Section

The document reading section 22 provided in the upper part of the image forming apparatus 10 includes a light source 44 that radiates light onto a read document G transported by an automatic document transport device 40 for transporting the read document G or a read document G placed on a platen glass 42.

The document reading section 22 further includes an optical system configurated by a full-rate mirror 46, a half-rate mirror 48, a half-rate mirror 50, and an imaging lens 52. Light radiated from the light source 44 is reflected by a read document G, and the reflected light is reflected by the full-rate mirror 46 in a direction parallel to the platen glass 42. The half-rate mirror 48 reflects the reflected light from the full-rate mirror 46 in a downward direction. The half-rate mirror 50 reflects and folds hack the reflected light from the half-rate mirror 48 in the direction parallel to the platen glass 42. The reflected light folded back by the half-rate mirror 50 enters the imaging lens 52.

The document reading section 22 further includes a photoelectric conversion element 54 that converts the reflected light imaged by the imaging lens 52 into electric signals, and an image processing unit 24 that subjects the electric signals converted by the photoelectric conversion element 54 to image processing.

The light source 44, the full-rate mirror 46, the half-rate mirror 48, and the half-rate mirror 50 are movable along the platen glass 42. To read a read document G placed on the platen glass 42, the light source 44 radiates light onto the read document G while moving the light source 44, the full-rate mirror 46, the half-rate mirror 48, and the half-rate mirror 50. Reflected light from the read document G is imaged on the photoelectric conversion element 54.

To read a read document G transported by the automatic document transport device 40, the light source 44, the full-rate mirror 46, the half-rate mirror 48, and the half-rate mirror 50 are stopped. The light source 44 radiates light onto the read document G, and reflected light from the read document G is imaged on the photoelectric conversion element 54.

Image Forming Section

Figure 4:
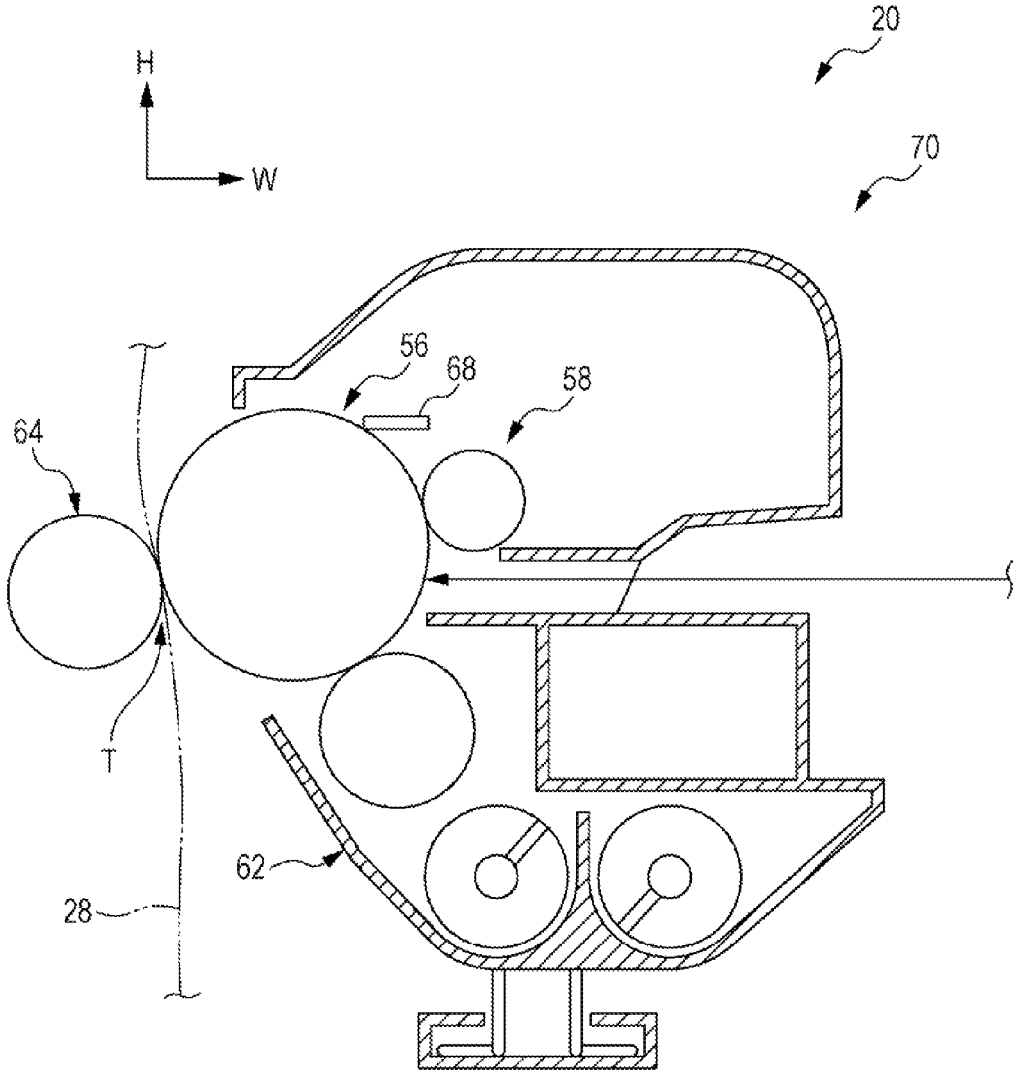
FIG. 4 is a structural view of an image forming section in an image forming apparatus according to the first exemplary embodiment.

As illustrated in FIG. 4, the image forming section 20 includes an image carrier 56, a charging roller 58 (an example of a charging member), an exposure device 60 (an example of an image forming member, see FIG. 5), and a developing device 62 (an example of an image forming member). The charging roller 58 charges a surface of the image carrier 56. The exposure device 60 forms an electrostatic latent image by radiating exposure light onto the charged surface of the image carrier 56 according to image data. The developing device 62 develops the electrostatic latent image into a visible toner image.

The image forming section 20 further includes a transfer roller 64, a fixing device 66 (see FIG. 5), and a cleaning blade 68. The transfer roller 64 transfers a toner image formed on the surface of the image carrier 56 onto a sheet member P transported along the transport path 28. The fixing device 66 is composed of a heating roller 66H and a pressurizing roller 66N, and fixes the toner image on the sheet member P with heat and pressure. The cleaning blade 68 cleans the image carrier 56 by scraping residual toner off the image carrier 56 after the toner image is transferred.

As illustrated in FIG. 5, a toner cartridge 72 connected to the developing device 62 by an unillustrated supply pipe is disposed on an obliquely upper side of the exposure device 60. The toner cartridge 72 stores toner to be supplied to the developing device 62 through the supply pipe.

In this configuration, when a sheet member P is fed out from the registration rollers 36, it is transported to the transfer position T defined by the image carrier 56 and the transfer roller 64 and is transported while being nipped therebetween. Thus, a toner image formed on the image carrier 56 is transferred onto the sheet member P.

Here, the image carrier 56, the charging roller 58, the developing device 62, and the cleaning blade 68 configurate an image forming unit 70. The image forming unit 70 is removably mounted in the apparatus body 10A.

The image carrier 56, the charging roller 58, and so on will be described in detail later.

Operation of Overall Configuration

In the image forming apparatus 10, an image is formed in the following procedure.

First, the charging roller 58 to which voltage is applied uniformly and negatively charges the surface of the image carrier 56 with a predetermined potential. Next, the exposure device 60 forms an electrostatic latent image by radiating exposure light onto the charged surface of the image carrier 56 on the basis of image data read by the document reading section 22 or externally input data.

The electrostatic latent image corresponding to the image data is thereby formed on the surface of the image carrier 56. This electrostatic latent image is developed into a visible toner image by the developing device 62.

A sheet member P is fed out from the storage member 26 into the transport path 28 by the feed roller 32 or is fed from the manual paper feed member 92 into the transport path 28 by the paper feed roller 94, and is sent to the transfer position T by the registration rollers 36 at a predetermined timing. At the transfer position T, the sheet member P is transported while being nipped between the image carrier 56 and the transfer roller 64, and the toner image formed on the surface of the image carrier 56 is thereby transferred onto a front surface of the sheet member P.

The transferred toner image is fixed on the sheet member P by passing between the heating roller 66H and the pressurizing roller 66H provided in the fixing device 66. Then, after the toner image is fixed on the front surface of the sheet member P, the sheet member P is output to the output portion 14 by the output rollers 76.

To also form an image on a back surface of the sheet member P, the sheet member P having the toner image on the front surface is not output to the output portion 74, but is sent to the reverse path 82 by reversing the output rollers 76. Thus, the sheet member P is inverted, and the transport rollers 84 transport the sheet member P to the registration rollers 36 again.

This time, a toner image is transferred onto the back surface of the sheet member P at the transfer position T, and the sheet member P having the toner image transferred on the back surface is then output to the output portion 74 in the above-described procedure.

Structure of Principal Part

Next, the image carrier 56, the charging roller 58, and so on will be described.

Charging Roller

Figure 3:
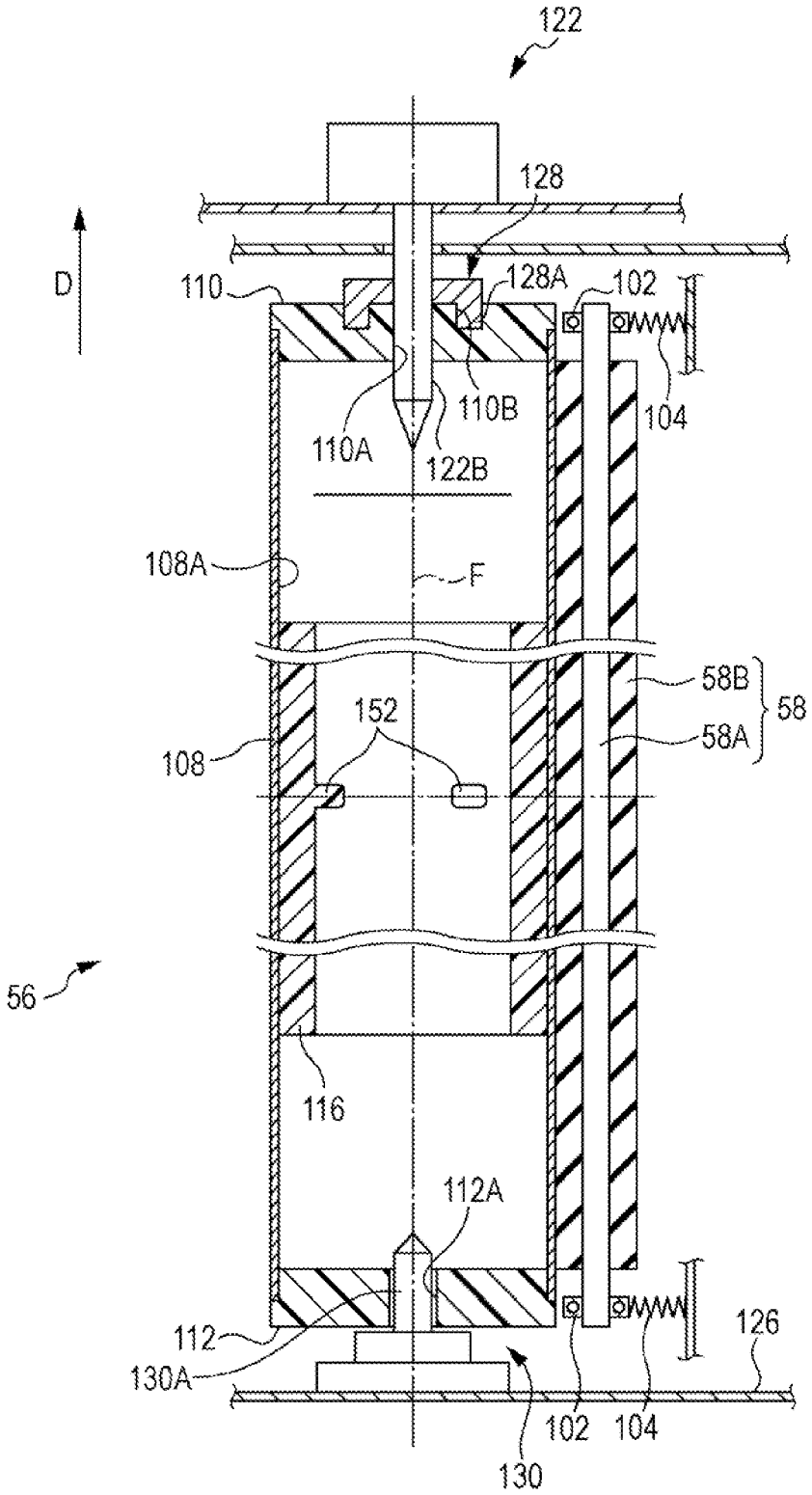
FIG. 3 is a cross-sectional view of an image carrier and a charging roller according to the first exemplary embodiment.

As illustrated in FIG. 3, the charging roller 58 includes a shaft portion 58A extending in the apparatus depth direction and made of a metal material (for example, stainless steel), and a roller portion 58B made of a rubber material and formed in the shape of a cylinder through which the shaft portion 58A extends.

Both ends of the shaft portion 58A are exposed outside from the roller portion 58B, and are rotatably supported by a pair of bearing members 102. Biasing members 104 for biasing the bearing members 102 toward the image carrier 56 are disposed on a side of the shaft portion 58A opposite from the image carrier 56.

With this structure, the roller portion 58B of the charging roller 58 is pressed against the image carrier 56. When the image carrier 56 rotates, the charging roller 58 is rotated along with the rotation. To the shaft portion 58A, a superimposed voltage obtained by superimposing an alternating-current voltage (1 to 2 kHz) on a direct-current voltage is applied from an unillustrated power supply. Thus, current flows from the charging roller 58 to the image carrier 56, and the surface of the image carrier 56 is charged.

Image Carrier

As illustrated in FIG. 3, the image carrier 56 includes a cylindrical body 108, a transmission member 110, and a support member 112. The cylindrical body 103 extends in the apparatus depth direction and is shaped like a cylinder. The transmission member 110 is fixed to one end (upper side in FIG. 3) of the cylindrical body 108 in the apparatus depth direction (direction similar to the axial direction of the cylindrical body 108). The support member 112 is fixed to the other end (lower side in FIG. 3) of the cylindrical body 108 in the apparatus depth direction. The image carrier 56 further includes a contact member 116 disposed within the cylindrical body 108 to suppress deformation of a cross section of the cylindrical body 108.

The cylindrical body 108 is obtained by forming a photosensitive layer on an outer peripheral surface of a cylindrical base member made of a metal material (for example, aluminum). For example, the cylindrical body 108 has a thickness of 0.8 mm, and a length of 250 mm in the apparatus depth direction.

The transmission member 110 is made of a resin material and formed in a disc shape. The transmission member 110 is fixed to the one end of the cylindrical body 108 with a part thereof being fitted in the cylindrical body 108, and closes the open one end of the cylindrical body 108. The transmission member 110 has a columnar through hole 110A on an axial center F of the cylindrical body 108. In an outer peripheral surface of the transmission member 110 facing outward in the apparatus depth direction, plural recesses 110B are provided such that the through hole 110A is located therebetween.

A motor shaft portion 122B of a motor 122 for generating rotating force to be transmitted to the transmission member 110 (image carrier 56) penetrates the through hole 110A of the transmission member 110. Also, a distal end portion 128A of a bracket 128 attached to the motor shaft portion 122B is bent and inserted in the recesses HOB of the transmission member 110.

The support member 112 is made of a resin material and formed in a disc shape. The support member 112 is fixed to the other end of the cylindrical body 108 with a part thereof being fitted in the cylindrical body 108, and closes the other open end of the cylindrical body 108. The support member 112 has a columnar through hole 112A on the axial center F of the cylindrical body 108.

A shaft portion 130A of a shaft member 130 that rotatably supports the support member 112 (image carrier 56) penetrates the through hole 112A, and the support member 112 functions as a so-called sliding bearing for the shaft portion 130A.

In this structure, rotating force generated by the motor 122 is transmitted to the transmission member 110 (image carrier 56) via the bracket 128, and rotates the image carrier 56 about the axial center F.

Contact Member

Next, a description will be given of the contact member 116 supported in contact with the inside of the cylindrical body 108 to suppress deformation of the cross section of the cylindrical body 108.

Figure 2A:
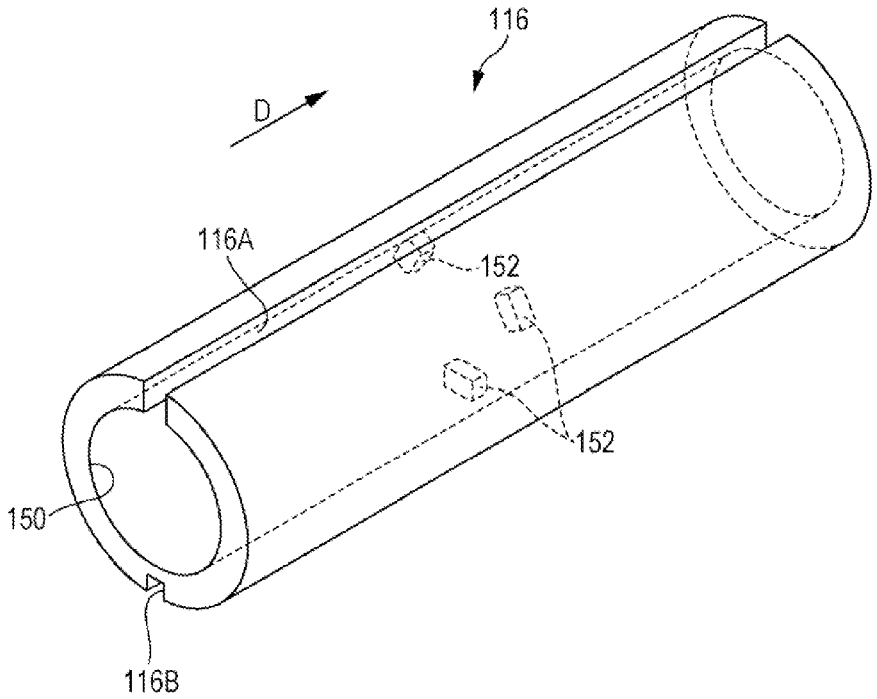
FIGS. 2A, 2B, and 2C are a perspective view, a cross-sectional view, and a cross-sectional view, respectively, of the contact member of the first exemplary embodiment.
Figure 2B:
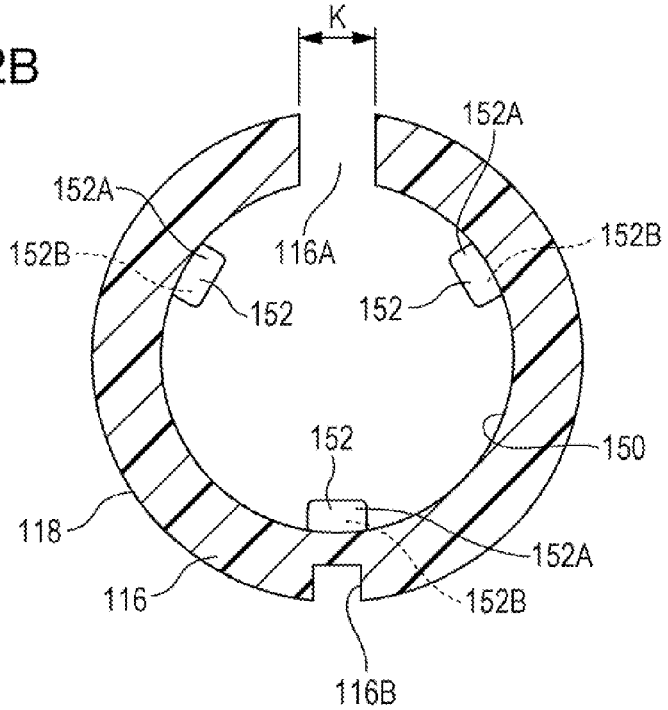
Figure 2C:
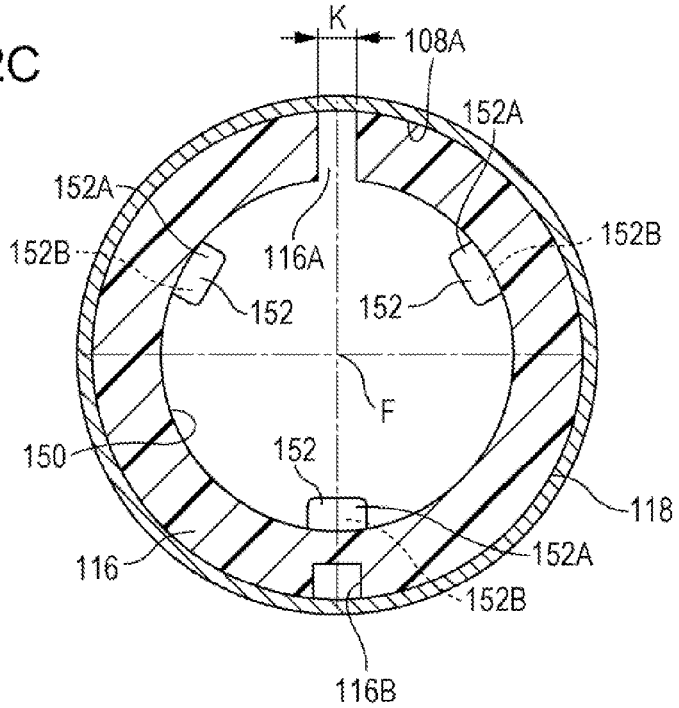

As illustrated in FIG. 2C, the contact member 116 is supported within the cylindrical body 108 with an outer peripheral surface 118 thereof (to be described later) being in contact with an inner peripheral surface 108A of the cylindrical body 108. As illustrated in FIG. 3, the contact member 116 is disposed on the center side in the apparatus depth direction within the cylindrical body 108.

Specifically, the contact member 116 is made of a resin material (for example, ABS (acrylonitrile-butadiene-styrene) resin), and is formed by injection molding. As illustrated in FIG. 2C, the contact member 116 is arc-shaped (C-shaped) or substantially arc-shaped along the inner peripheral surface 108A of the cylindrical body 108, when viewed from the apparatus depth direction. An outer peripheral surface 118 of the contact member 116 and an inner peripheral surface 150 of the contact member 116 are arc-shaped, when viewed from the apparatus depth direction. Both end portions of the contact member 116 are separate from and opposed to each other in the circumferential direction. Between the opposed end portions, a separate space 116A is provided. As illustrated in FIG. 2A, the contact member 116 extends in the apparatus depth direction. For example, the thickness of a general portion of the contact member 116 is 4 mm, and the length of the contact member 116 in the apparatus depth direction is 100 mm.

Further, as illustrated in FIG. 2C, a groove portion 116B extending in the apparatus depth direction is provided on a portion of the outer peripheral surface 118 of the contact member 116 on a side of the axial center F of the cylindrical body 108 opposite from the separate space 116A in a state in which the contact member 116 is disposed within the cylindrical body 108.

In a state in which the contact member 116 is not disposed within the cylindrical body 108 (see FIG. 2B), a separate distance (distance K in FIG. 2B) of the separate space 116A is longer than the separate distance K when the contact member 116 is disposed within the cylindrical body 108 (see FIG. 2C).

In this structure, when the contact member 116 is placed within the cylindrical body 108, it is held and the groove portion 116B is deformed to shorten the separate distance K. The contact member 116 is thereby bent, and is inserted in the bent state into the cylindrical body 108. Then, the force for holding the contact member 116 is removed, and the contact member 116 is further pushed into the cylindrical body 108. Thus, the outer peripheral surface 118 of the contact member 116 comes into contact with the inner peripheral surface 108A of the cylindrical body 108, and the contact member 116 is disposed and supported within the cylindrical body 108.

On the inner peripheral surface 150 of the contact member 116, three projections 152 projecting toward the axial center F are arranged in the circumferential direction of the inner peripheral surface 150. In the state in which the contact member 116 is disposed within the cylindrical body 108, the projections 152 are similarly spaced in the circumferential direction, when viewed from the apparatus depth direction. As illustrated in FIG. 2A, the projections 152 are disposed on the center side of the contact member 116 in the apparatus depth direction. That is, the projections 152 are disposed at positions apart from end portions of the inner peripheral surface 150 in the apparatus depth direction.

Each of the projections 152 has a depth face 152A facing toward one side in the apparatus depth direction, and a depth face 152B facing toward the other side in the apparatus depth direction.

Operation of Principal Structure

Next, descriptions will be given of the effect provided by the contact member 116 during operation of the image forming apparatus 10 and a process for taking the contact member 116 out of the cylindrical body 108 for recycling when disposing of the image forming apparatus 10.

First, the effect provided by the contact member 116 during operation of the image forming apparatus 10 will be described.

When the motor 122 is operated, the image carrier 56 rotates (see FIG. 3). When the image carrier 56 rotates, the charging roller 58 is rotated along with the rotation. To charge the unillustrated photosensitive layer of the image carrier 56, a superimposed voltage obtained by superimposing an alternating-current voltage (1 to 2 kHz) on a direct-current voltage is applied from the power supply to the shaft portion 58A of the charging roller 58.

By the alternating-current voltage included in the superimposed voltage, an alternating electric field is generated between the charging roller 58 and the image carrier 56. Thus, a periodic electrostatic attractive force (2 to 4 kHz) is generated between the image carrier 56 and the charging roller 58. For this reason, the cross section of the cylindrical body 108 is going to periodically change (vibrate) in a circular shape and an elliptic shape.

However, the image carrier 56 of the first exemplary embodiment is provided with the contact member 116. As illustrated in FIG. 2B, the cylindrical body 108 is supported within the cylindrical body 108 with the outer peripheral surface 118 being in contact with the inner peripheral surface 108A of the cylindrical body 108. For this reason, even when the cross section of the cylindrical body 108 is going to periodically change, the change (vibration) of the cylindrical body 108 may be suppressed.

When vibration of the cylindrical body 108 is suppressed, the occurrence of noise due to vibration of the cylindrical body 108 may be suppressed.

Next, a description will be given of the process for taking the contact member 116 out of the cylindrical body 108 for recycling when disposing of the image forming apparatus 10.

As described above, the contact member 116 is made of resin and the cylindrical body 108 is made of metal. Accordingly, to recycle the contact member 116, the contact member 116 and the cylindrical body 108 need to foe separated from each other when disposing of the image forming apparatus 10 or the image carrier 56.

Figure 1A:
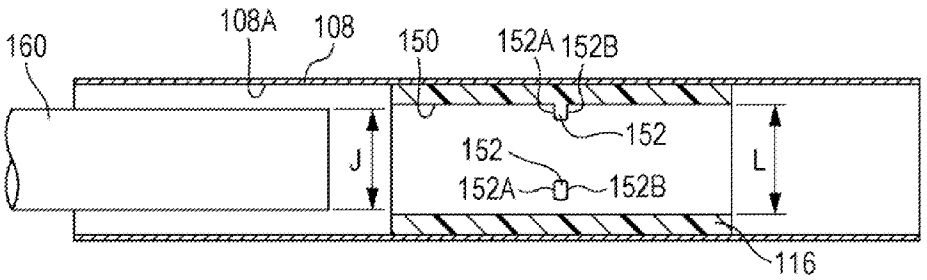
FIGS. 1A, 1B, and 1C are process views illustrating an operation of taking out a contact member according to a first exemplary embodiment of the present invention from a cylindrical body.

To take the contact member 116 out of the cylindrical body 108, first, as illustrated in FIG. 1A, a distal end portion of a columnar rodlike member 160 (an example of a jig) is inserted into the cylindrical body 108 from one side (left side in FIG. 1A) of the cylindrical body 108. Here, the outer diameter (J in FIG. 1A) of the rodlike member 160 is smaller than the inner diameter (L in FIG. 1A) of the contact member 116 disposed within the cylindrical body 108, and is set such that the rodlike member 160 comes into contact with ail of the projections 152 when inserted in the contact member 116.

Figure 1B:
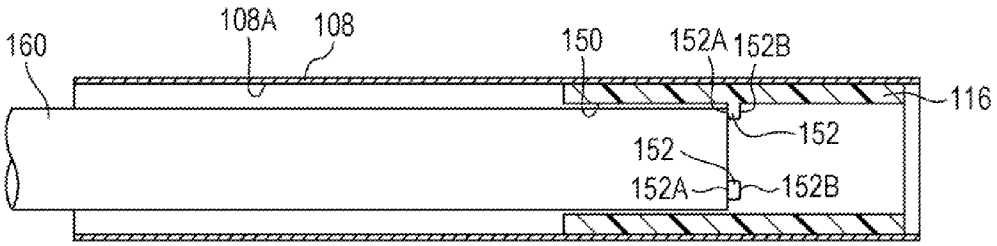

When the rodlike member 160 with the distal end portion inserted in the cylindrical body 108 is pushed into the cylindrical body 108, the distal end portion of the rodlike member 160 is inserted into the contact member 116. When the distal end portion of the rodlike member 160 is further inserted into the contact member 116, it is guided by the inner peripheral surface 150 of the contact member 116, and comes into contact with the depth faces 152A of the projections 152, as illustrated in FIG. 1B. Then, the projections 152 are pushed by the rodlike member 160, and the contact member 116 is moved toward the other side (right side in FIG. 1B) of the cylindrical body 108.

Figure 1C:
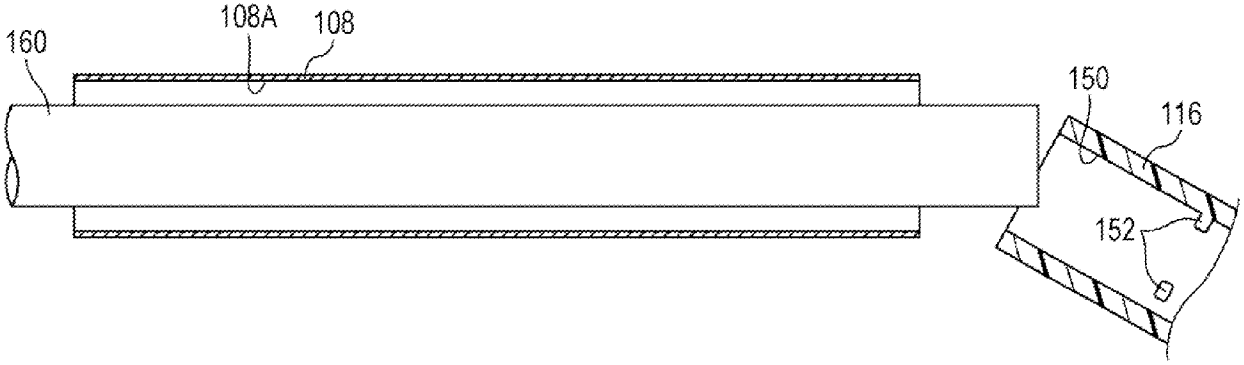

When the projections 152 are further pushed by the rodlike member 160, as illustrated in FIG. 1C, the contact member 116 is ejected from the other side of the cylindrical body 108 and is taken out of the cylindrical body 108.

In contrast, a description will be given of a process for taking a contact member 200 according to a comparative example out of a cylindrical body 108. The contact member 200 does not have projections 152, but other structures of the contact member 200 are similar to those of the contact member 116.

Figure 6A:
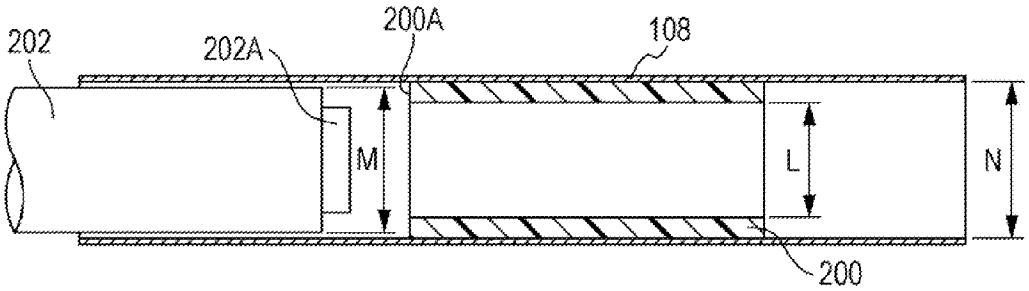
FIGS. 6A, 6B, and 6C are process views illustrating an operation of taking out a contact member according to a comparative example, in contrast to the contact member of the first exemplary embodiment, from a cylindrical body.

To take the contact member 200 out of the cylindrical body 108, first, as illustrated in FIG. 6A, a distal end portion of a columnar rodlike member 202 is inserted into the cylindrical body 108 from one side (left side in FIG. 6A) of the cylindrical body 108. The distal end portion of the rodlike member 202 is provided with a projection 202A to be inserted into the contact member 200. Here, the outer diameter (M in FIG. 6A) of the rodlike member 202 is smaller than the inner diameter (H in FIG. 6A) of the cylindrical body 108, and is larger than the inner diameter (L in FIG. 6A) of the contact member 200 disposed within the cylindrical body 108.

Figure 6B:
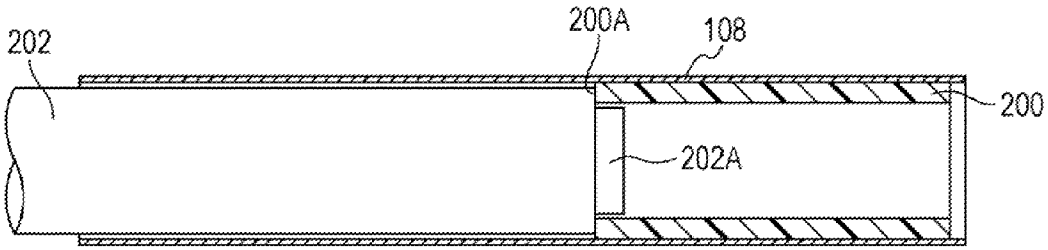

When the distal end portion of the rodlike member 202 is inserted in the cylindrical body 108, as illustrated in FIG. 6B, it comes into contact with an end face 200A of the contact member 200. Then, the end face 200A is pushed by the rodlike member 202, and the contact member 200 is moved toward the other side (right side in FIG. 6B) of the cylindrical body 108.

Figure 6C:
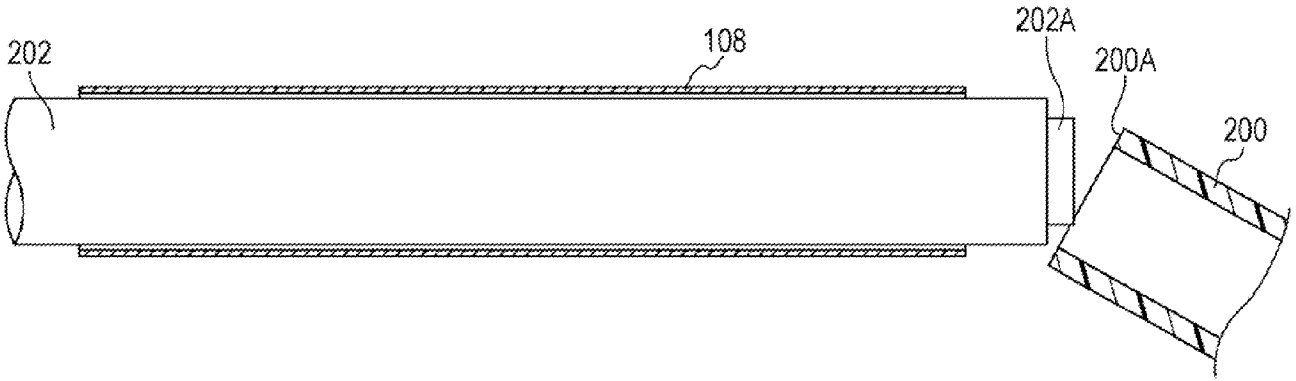

When the end face 200A is further pushed by the rodlike member 202, as illustrated, in FIG. 6C, the contact member 200 is ejected from the other side of the cylindrical body 108 and is taken out of the cylindrical body 108.

Conclusion

As described above, the contact member 116 of the first exemplary embodiment has the projections 152. For this reason, the outer diameter of the rodlike member 160 used to take the contact member 116 out of the cylindrical body 108 is smaller than the inner diameter of the contact member 116 disposed within the cylindrical body 108. In contrast, the contact member 200 of the comparative example does not have the projections 152. For this reason, the outer diameter of the rodlike member 202 used to take the contact member 200 out of the cylindrical body 108 is smaller than the inner diameter of the cylindrical body 108, and is larger than the inner diameter of the contact member 200 disposed within the cylindrical body 108.

Second Exemplary Embodiment

Next, a contact member, an image carrier, and an image forming apparatus according to a second exemplary embodiment of the present invention will be described with reference to FIG. 7A. The same members as those adopted in the first exemplary embodiment are denoted by the same reference numerals, and descriptions thereof are skipped. Differences from the first exemplary embodiment will be described.

Figure 7A:
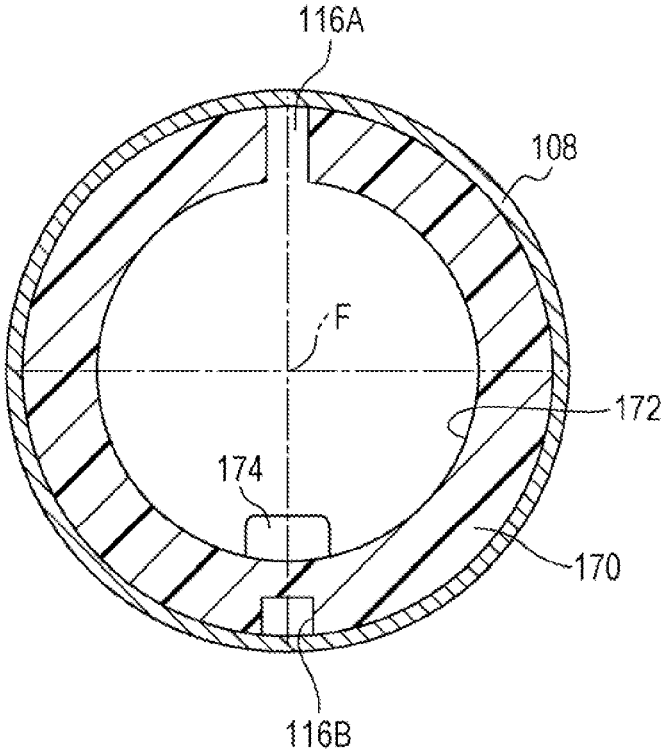
FIGS. 7A and 7B are cross sectional views of a contact member according to a second exemplary embodiment of the present invention and a contact member according to a third exemplary embodiment of the present invention, respectively.

In the second, exemplary embodiment, as illustrated in FIG. 7A, one projection 174 projecting toward the axial center F is provided, on an inner peripheral surface 172 of a contact member 170.

Effects of the contact, member 170 are similar to those of the contact member 116 of the first exemplary embodiment except for the effect obtained by forming three projections.

Third Exemplary Embodiment

Next, a contact member, an image carrier, and an image forming apparatus according to a third exemplary embodiment of the present invention will be described with reference to FIG. 7B. The same members as those adopted in the first exemplary embodiment are denoted by the same reference numerals, and descriptions thereof are skipped. Differences from the first exemplary embodiment will be described.

Figure 7B:
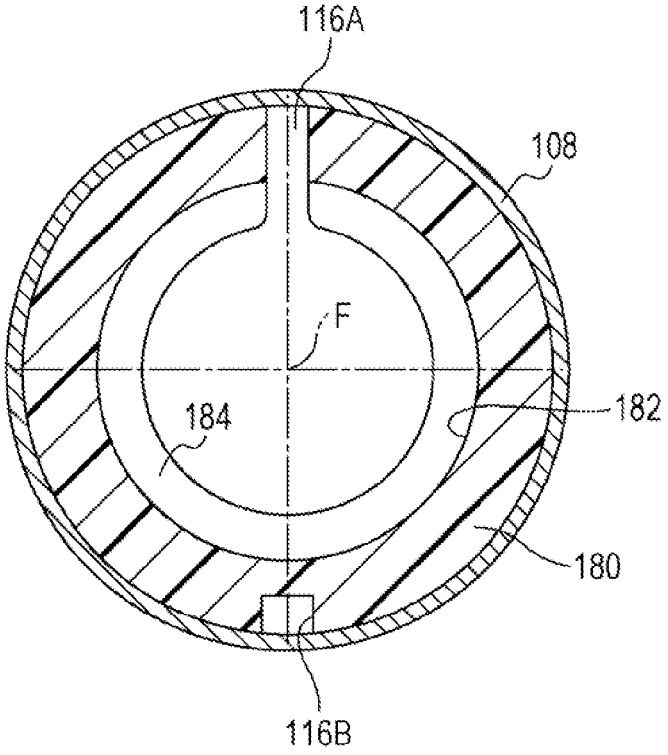

In the third exemplary embodiment, as illustrated in FIG. 7B, a projection 184 is provided all over the inner peripheral surface 182 of a contact member 180 in the circumferential direction.

Since the projection 184 is thus provided all over the inner peripheral surface 182 in the circumferential direction, it is more effectively pushed by a rodlike member 160 than when the projection is locally provided.

Effects of the contact member 180 are similar to those of the contact member 116 of the first exemplary embodiment except for the effect obtained, by forming three projections.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

For example, while the three projections 152 are provided in the first exemplary embodiment and the one projection 174 is provided in the second exemplary embodiment, the number of projections may be two, or four or more. When plural projections are provided, they are restricted from being tilted by the pushing force, compared with the case in which one projection is provided. This may allow the pushing force of the rodlike member 160 to be effectively transmitted to the contact member.

While the projections 152, 174, and 184 are respectively disposed at the positions separate from the end portions of the inner peripheral surfaces 150, 172, and 182 in the apparatus depth direction in the above-described exemplary embodiments, they may be disposed in the end portions in the apparatus depth direction.

While one contact member 116, 170, or 180 is disposed within the cylindrical body 108 in the above-described exemplary embodiments, two or more contact members may be disposed within the cylindrical body 108.

What is claimed is:

1. A contact member provided in a substantially arc shape along an inner peripheral surface of a rotating cylindrical body while being supported in contact with an inside of the cylindrical body, when viewed from an axial direction of the cylindrical body, and having at least one projection projecting from an inner peripheral surface of the contact member, the at least one projection being spaced apart from axial ends of the contact member, the contact member extending along an inner surface of the cylindrical body and spaced a distance from both ends of the cylindrical body, and being configured to suppress deformation of the cross-section of the cylindrical body.

2. The contact member according to claim 1, wherein the at least one projection includes a plurality of projections provided in a circumferential direction of the inner peripheral surface.

3. The contact member according to claim 1, wherein the at least one projection is provided all over the inner peripheral surface in a circumferential direction.

4. The contact member according to claim 1, wherein the at least one projection is disposed at a position apart from an end portion of the inner peripheral surface in the axial direction.

5. An image carrier comprising:

a cylindrical body that rotates and holds an image on a surface thereof; and the contact member according to claim 1, the contact member being supported within the cylindrical body.

6. An image forming apparatus comprising:

the image carrier according to claim 5;

a charging member to which a superimposed voltage obtained by superimposing an alternating-current voltage on a direct-current voltage is applied to charge the surface of the image carrier; and an image forming member that forms an image on the charged surface of the image carrier.

7. The contact member according to claim 1, wherein the contact member is removably coupled with the inside of the cylindrical body and is configured to allow for removal and disposal thereof when a force is applied to the at least one projection by a rodlike member in the axial direction to move the contract member along the axial direction within the cylindrical body and out of one side of the cylindrical body.

8. The contact member according to claim 1, further comprising a transmission member fixed to one end of the cylindrical body and separate from the contact member.

* * * * *